United States Patent [19]

Mochida et al.

[11] Patent Number: 4,607,689

[45] Date of Patent: Aug. 26, 1986

[54] REHEATING DEVICE OF STEAM POWER PLANT

[75] Inventors: Yoshio Mochida, Ebina; Toshiaki Ozeki, Yokohama; Kenji Satoh, Yokohama; Yoshitaka Yuasa, Yokohama, all of Japan

[73] Assignee: Tokyo Shibaura Denki Kabushiki Kaisha, Kawasaki, Japan

[21] Appl. No.: 564,678

[22] Filed: Dec. 23, 1983

[30] Foreign Application Priority Data

Dec. 27, 1982 [JP] Japan ..... 57-232337

[51] Int. Cl.[4] ..... F28B 1/00

[52] U.S. Cl. ..... 165/110; 165/174; 122/406 B; 122/483

[58] Field of Search ..... 165/174, 178, 133, DIG. 8, 165/110; 122/406 B, 483

[56] References Cited

U.S. PATENT DOCUMENTS

| | | | |
|---|---|---|---|
| 1,748,121 | 2/1930 | Gay | 122/406 B |
| 1,988,659 | 1/1935 | La Mont | 122/406 B |
| 2,143,477 | 1/1939 | Dillon et al. | 165/174 |
| 2,310,234 | 2/1943 | Haug | 165/174 |
| 2,620,830 | 12/1952 | Schultz | 165/178 |
| 3,317,222 | 5/1967 | Maretzo | 165/174 |
| 3,707,186 | 12/1972 | Zorrilla et al. | 165/178 |
| 3,830,293 | 8/1974 | Bell | 165/174 |
| 4,174,750 | 11/1979 | Nichols | 165/174 |
| 4,300,481 | 11/1981 | Fisk | 165/174 |
| 4,334,554 | 6/1982 | Geiger et al. | 122/406 B |
| 4,449,575 | 5/1984 | Laws et al. | 165/178 |
| 4,452,302 | 6/1984 | Schoerner | 165/133 |

FOREIGN PATENT DOCUMENTS

| | | | |
|---|---|---|---|
| 54-2329 | 2/1979 | Japan | 174/ |

*Primary Examiner*—Albert W. Davis, Jr.
*Assistant Examiner*—Peggy A. Neils
*Attorney, Agent, or Firm*—Schwartz, Jeffery, Schwaab, Mack, Blumenthal & Evans

[57] ABSTRACT

A reheater for a steam power plant generally comprises a tube plate, a header including a high-temperature chamber and a low-temperature chamber defined outwardly of the tube plate, and a number of heat-exchanger tubes bent into U-shapes, both ends of which are secured to the tube plate. The reheater further comprises nozzle members, each having a flange portion, inserted into the upstream ends of the heat-exchanger tubes, respectively, and a bellmouth plate having a number of holes, secured detachably to the tube plate such that the holes align with the nozzle members. The flange portions of the nozzle members are secured firmly between the bellmouth plate and the tube plate.

1 Claim, 12 Drawing Figures

REHEATING DEVICE OF STEAM POWER PLANT

BACKGROUND OF THE INVENTION

This invention relates to a reheating device to be used with a steam power plant, and more particularly to a reheating device of the type adapted to prevent subcooling of condensate created at the outlet ends of U-shaped heat exchanger tubes.

In an ordinary nuclear power plant of the type of boiling water reactor or pressurized water reactor, steam supplied to the steam turbine is far wetter than that of fossil power plants. Because of the corrosion of the turbine blades and an adverse effect on the thermal efficiency, moisture content must be removed out of the wet steam. The removal of the moisture content is ordinarily realized by use of a moisture separator of, for instance, a chevron type, having corrugated plates with drain pockets, which is provided between a high-pressure turbine and a low-pressure turbine of the nuclear power plant, so that the moisture content of about 10% contained in the steam exhausted from the high-pressure turbine is reduced to less than 1%. The steam with the moisture content thus reduced is then reheated in a reheating device by means of steam extracted from the high-pressure turbine or steam generated from the nuclear reactor in a reheating cycle of the turbine operation for improving the thermal efficiency and protecting turbine blades from corrosion. The reheater and the moisture separator are ordinarily provided commonly in the shell, the combined device being ordinarily termed a moisture separator reheater.

Two types of moisture separator reheater are available for such purposes, one being a single stage type heated by the steam generated from the nuclear reactor, and the other being a two stage type heated firstly by the steam extracted from the high-pressure turbine, and secondly by the steam generated from the nuclear reactor. Both types of the reheating devices are constructed in the form of a multitube type heat exchanger wherein high temperature heating steam flows inside of the tubes, while the steam to be reheated flows outside of the tubes.

FIGS. 1 through 4 illustrate a conventional two-stage type reheating device combined with a moisture separator. The moisture separator reheater comprises a shell 1 of a horizontally extending cylindrical configuration. Two steam inlet pipes 2 and one drain exhaust pipe 3 are connected to lower portions of the shell 1, to the upper portions of which two steam outlet pipes 4 are connected. End plates 5 enclose both longitudinal ends of the shell 1 entirely, and internally of the end plates 5, there are provided two partition plates 6 which extend vertically so as to separate the interior of the shell 1 into different portions.

As illustrated in FIG. 2 clearly, the conventional device further comprises a bottom plate 7 provided in a lower part of the shell 1 to extend horizontally among the partition plates 6, a ceiling plate 8 provided above the bottom plate 7 to extend in parallel with the bottom plate 7, and two steam distributing plates 9 extending between the bottom plate 7 and the ceiling plate 8 obliquely upwardly so as to form a steam distributing chamber 10 of a triangular cross-section on the bottom plate 7. Moisture separating devices 11 are further provided laterally outwardly of the steam distributing plates 9 between the bottom plate 7 and the ceiling plate 8 for separating the moisture content out of the wet steam introduced into the steam distributing chamber 10.

Two plates 12 are further extended obliquely upwardly from the lateral edges of the ceiling plate 8 so that the upper edges of the plates 12 are combined together in an angular relation. Outwardly of the plates 12, plates 13 are further provided in parallel with the two plates 12, so that two steam reheating passages 14 are formed between the plates 12 and 13, respectively. The upper ends of the steam reheating passages 14 are combined into a single passage connected to the steam outlet pipes 4. In each of the steam reheating passages 14, heat exchanger tubes 17 bent into U-shape are provided.

In the spaces formed between the end plates 5 and the partition plates 6 provided at both ends of the shell 1, there are provided a first header 15 and a second header 16 for the first and second steam reheating devices, respectively. As best illustrated in FIGS. 3 and 4, each of headers 15 and 16 is divided by a partition wall 18 for separating the pass into a high-temperature chamber 19 and a low-temperature chamber 20, and the aforementioned U-shaped heat-exchanger tubes 17 are provided so that the upstream ends thereof open in the high-temperature chamber 19, while the downstream ends thereof open in the low-temperature chamber 20. A tube plate 26 has holes, not shown, in which the upstream and downstream ends of the U-shaped tubes 17 are tightly received, and a plurality of support plates 21 for supporting the heat-exchanger tubes 17 in a spaced apart relation are provided in each of the steam reheating devices, so that the support plates 21 prevent the tubes 17 from vibrations and the like. A heating steam inlet pipe 22 is connected with the high-temperature chamber 19, while a drain exhaust pipe 23 and a vent steam outlet pipe 24 are connected with the low-temperature chamber 20. A manhole 25 is further provided in the low-temperature chamber 20.

In the above described moisture separator reheater of conventional construction, the steam to be reheated supplied through the steam inlet pipe 2 flows in the steam distributing chamber 10 in the shell 1 and is then divided by the steam distributing plates 9 into two parts. The steam then flows through the moisture separating devices 11, each having corrugated plates with drain pockets, which remove the moisture content out of the steam. The moisture content (or drain) thus removed from the steam flows downwardly out of the device 11 by a gravitational force, and is exhausted through the drain exhaust pipe 3 into a drain tank, not shown. The steam passed through the moisture separating devices 11 is guided to flow through the steam reheating passages 14 in the first and second steam reheating devices. While the steam passes between the U-shaped heat exchanger tubes 17 of the steam reheating devices, the steam is heated by the heating steam flowing inside of the heat-exchanger tubes 17, and the steam thus heated into a superheated condition is then sent through the two steam outlet pipes 4 into the low-pressure turbine.

On the other hand, the heating steam extracted from the high-pressure turbine or received from the nuclear reactor is introduced through the heating steam inlet pipe 22 into the high temperature chamber 19 of the header 15 or 16. The heating steam is then caused to flow through the U-shaped heat exchanger tubes 17. In the tubes 17, the heat of the heating steam is given to the steam to be reheated flowing outside of the heat exchanger tubes 17, so that the heating steam is gradually cooled into a condensed state. That is, the heating steam thus cooled flows through the interior of the heat exchanger tubes 17 in the form of two-phase flow such as annular, wavy, and laminar flow condition. As a consequence, the heating steam, at the entrance portion of the heat exchanger tube 17, which has been in a vapor phase of a quality (wt % of vapor) substantially equal to 1 is changed into a quality substantially equal to 0 mostly composed of drain at the delivery portion of the tube 17. The steam mostly composed of drain is then sent through the low-temperature chamber 20 of the header 15 or 16 into the drain tank. A portion of the steam not condensed into drain is delivered outside through the vent steam outlet pipe 24.

It should be noted that the heating steam and steam flow through the first and second reheating devices in substantially the same manner. Heat exchanger tubes 17 of a low-fin type are ordinarily utilized because the heat transfer coefficient within the tubes 17 accompanying condensation phenomenon is higher than that of the exterior of the tubes wherein heat is transferred in a single phase of steam.

The flow condition of steam in each heat exchanger tube 17 is not always same as described above, but is varied depending on each tube. As shown in FIG. 4 the inlet and outlet ends of the U-shape tubes 17 are connected to the high-temperature chamber 19 and the low-temperature chamber 20, and the reheated steam outside the tubes 17 flows vertically upwardly relative to the heat-exchanger tubes 17. Accordingly, in the upper leg of a heat-exchanger tube 17*a* located at an outermost position among the bundle of the tubes 17, the heat duty becomes minimum, because the reheated steam outside that part of the tube 17*a* has been heated to a high temperature by the heat-exchanger tubes 17 below the upper leg of the tube 17*a*, and hence the temperature difference between the interior and exterior of the upper leg of the tube 17*a* becomes minimum. On the other hand, in the lower leg of the heat-exchanger tube 17*a*, heat is transferred between the heating steam within the tube 17*a* and reheated steam outside thereof which has not yet been heated by other heat exchanger tubes 17, and hence the temperature difference between the interior and exterior of the part of the tube 17*a* becomes maximum, and the heat duty also becomes maximum.

The flow rate of the heating steam flowing through the heat exchanger tube 17 is mostly determined by the heat duty in the tube, and therefore the distribution of the heating steam flowing through the tubes 17 must be reduced depending on the position of the tubes 17 from the outermost tube 17*a* toward the innermost tube 17*b*. However, the heat-exchanger tubes are all connected commonly between the high-temperature chamber 19 and the low-temperature chamber 20, and are thus subjected to the same pressure difference determined by the operating condition of the reheating device. As a consequence, the flow rate of the heating steam flowing through the heat exchanger tubes 17 is determined automatically by a flow resistance in the tubes 17 and the heat duty in these tubes 17.

In cases where the pressure difference between the high-temperature chamber 19 and the low-temperature chamber 20 is not high, a static pressure at a position in the lower leg of the outermost tube 17*a*, for example, tends to be made equal to that of the low-temperature chamber 20, and the flow of the heating steam in the tube 17*a* is blocked at that point. However, the heat-exchange caused thereafter in the tube part continuously produces drain which gradually fills the interior of the tube 17*a* at that position. The drain is further cooled by the reheated steam flowing outside of the tube in such an extent that the subcooling of the condensate of 50° to 60° C. is frequently caused.

Furthermore, in accordance with increase in drain filling interior of the tube, the heating surface is reduced as well as the quantity of steam flowing therethrough. The reduction of the steam flow reduces the two-phase flow resistance in the tube, thereby increasing the pressure applied across the drain-filled part, and exhausting the subcooled drain into the low-temperature chamber 20. Since a portion, from which the drain has been exhausted, provides a new heating surface, a large quantity of heating steam flows into the tube, thereby causing a hunting phenomenon. When the difference in heat duty between an outer tube such as tube 17*a* and an inner tube such as a tube 17*b* shown in FIG. 4 increases, the hunting phenomenon is exaggerated.

More specifically, the drain is caused to stay at an upstream side of the lower leg of the tube 17*a*, and the steam not yet condensed and held in the low-temperature chamber 20 flows back into the part of the tube on the downstream side of the drain staying portion. In this case, a periodic temperature variation occurs in a portion where the heat exchanger tube is welded to a tube plate 26, thus inevitably entailing a problem of thermal fatigue. The above described hunting phenomenon and the causing of fatigue in the welded part between the heat-exchanger tube and the tube plate 26, must be avoided for improving the reliability and safety of the control system of a nuclear power plant.

For overcoming the difficulty, there has been proposed a device wherein an orifice plate having a number of holes is secured to the tube plate, for instance by welding, while the holes are aligned with those of the tube plate, and the diameter of the holes are varied in accordance with the temperature distribution of steam flowing outside of the tubes 17. Although such a device is simple in construction and easy in realization, various difficulties have been encountered when it is used practically. Since the orifice plate has been welded directly to the tube plate, the removal of the orifice plate at the time of inspection and maintenance of the heat-exchanger tubes is not easy. Furthermore, gaps tend to be created between the orifice plate and the tube plate so as to provide leakage paths of steam by-passing some part of heat exchanger tubes 17, and making it difficult to guarantee appropriate operation of the orifice plate. In cases where a sufficient anti-corrosive property cannot be assured for the material of the heat exchanger tubes, the tubes tend to be corroded by vortices produced after the orifice plate.

SUMMARY OF THE INVENTION

An object of the present invention is to provide a reheating device of a steam power plant for obviating the above described difficulties of the conventional devices.

Another object of this invention is to provide a reheating device of a steam power plant which is simple in construction and economical in manufacture.

Still another object of this invention is to provide a reheating device of a steam power plant in which reliability and safety of the operation can be assured and in which ease of inspection and maintenance can be guaranteed.

Yet another object of this invention is to provide a reheating device of a steam power plant in which a hunting phenomenon due to the subcooling of the condensate and thermal fatigue thereby caused in welded parts of heat exchanger tubes can be prevented and the operability of the power plant can be substantially improved.

According to the present invention, there is provided a steam reheating device for a steam power plant comprising a tube plate, a header provided outside of the tube plate so that the header is divided internally into a high-temperature chamber and a low-temperature chamber and a number of heat-exchanger tubes bent into U-shape, both ends of the heat-exchanger tubes being secured to the tube-plate such that the upstream ends of the tubes are connected to the high-temperature chamber, while the downstream ends of the tubes are connected to the low-temperature chamber, and the steam reheating device further comprises nozzle members, each having a flange portion, inserted into the upstream ends of the heat exchanger tubes, respectively, and a bellmouth plate having a number of holes, secured detachably to the tube plate in such a manner that the holes of the bellmouth plate are brought into alignment with nozzle holes of the nozzle members, and the flange portions of the nozzle members are firmly seized between the bellmouth plate and the tube plate.

DESCRIPTION OF THE PREFERRED EMBODIMENTS

Figure 1:
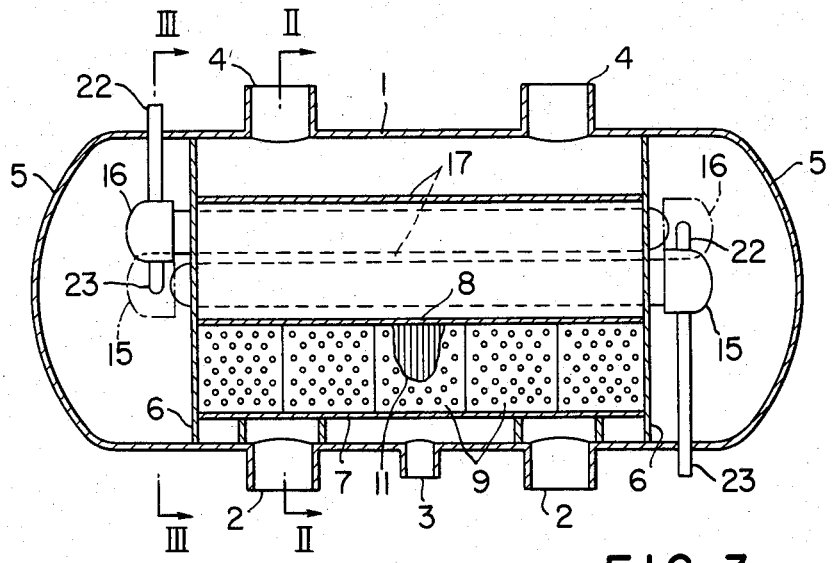
FIG. 1 PRIOR ART
FIG. 1 is a longitudinal sectional view showing a conventional moisture separator reheater.
Figure 2:
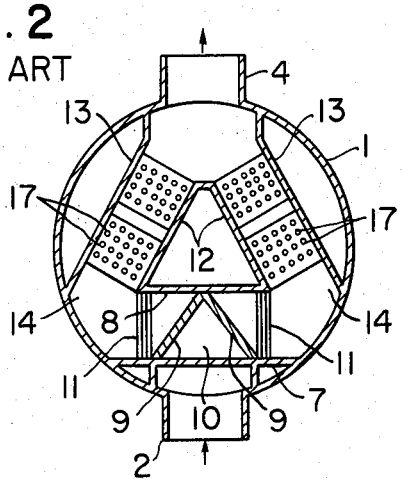
FIG. 2 PRIOR ART
FIG. 2 is a cross-sectional view taken along the line II—II in FIG. 1.
Figure 3:
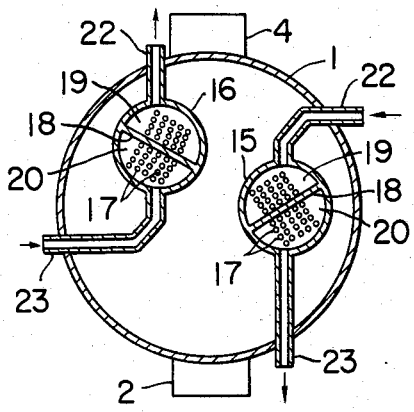
FIG. 3 PRIOR ART
FIG. 3 is another cross-sectional view taken along the line III—III in FIG. 1.

Various embodiments of the present invention will now be described with reference to FIGS. 5 through 12, wherein similar members are designated by similar reference numerals.

Figure 4:
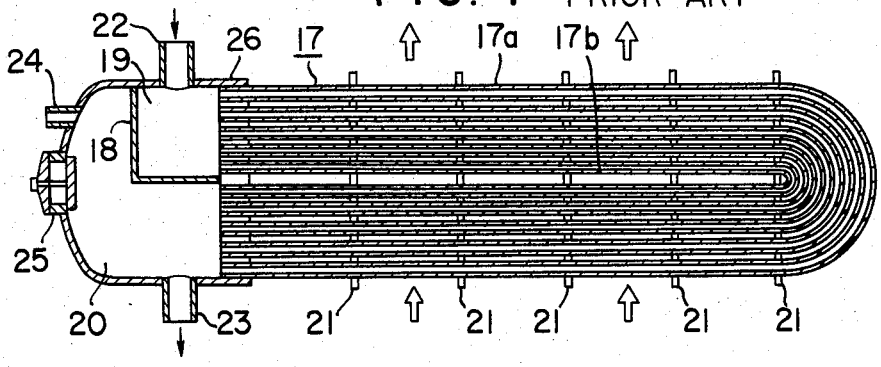
FIG. 4 PRIOR ART
FIG. 4 is a longitudinal sectional view of a reheater used in the device shown in FIG. 1.
Figure 5:
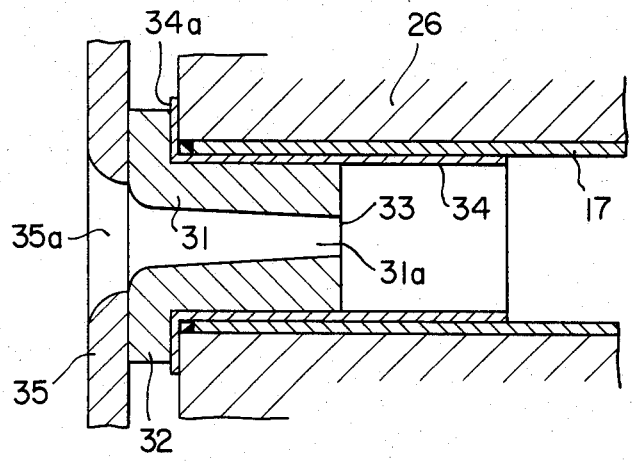
FIG. 5 is a longitudinal sectional view showing a nozzle and a bellmouth plate used in a preferred embodiment of the present invention.

Referring to FIG. 5 showing a part of the reheater shown in FIG. 4, since an upstream end of one of the heat exchanger tubes 17 extends in a tube plate 26 of the reheater, the upstream end terminates at a position substantially coplanar with the outer surface of the tube plate 26 and is welded at this position to the tube plate 26. A nozzle member 31 having an outer diameter sufficiently smaller than the inner diameter of the heat-exchanger tube 17 is inserted into the upstream end of the heat-exchanger tube 17. The nozzle member 31 has an integral flange portion 32 which is exposed outwardly after the member 31 is inserted in the tube 17. An insert pipe 34 also having an integral flange portion **34*a* is inserted between the heat exchanger tube 17 and the nozzle member 31, so that the flange portion 34*a* can be held between the flange portion 32 of the nozzle 31 and the outer surface of the tube plate 26. The nozzle member 31 has a longitudinally extending central hole 31*a* having a diameter gradually reduced toward the downstream end designated at 33. The insert pipe 34 extends downstream in excess of the nozzle tip hole 33 for a distance sufficient to protect the internal surface of the heat-exchanger tube 17 from being corroded by the vortex caused behind the nozzle tip hole 33**.

A bellmouth plate 35 provided with a number of holes **35*a*, each having a stream-lined or bellmouth shaped entrance portion, is secured to the tube plate 26 by, for instance, bolts or studs, not shown. The bellmouth plate 35 thus presses the flange portions 32 of the nozzle members 31 toward the tube plate 26 while the holes 35*a* being maintained in center-to-center alignment with the nozzle members 31. According to the present invention, the diameter of the nozzle tip hole 33 is reduced in accordance with the position of the heat-exchanger tube containing the nozzle member 31**, which is varied from the outermost position toward the innermost position.

With the above described construction, the reheating steam supplied into the high-temperature chamber 19 in the header, through a heating steam inlet pipe 22, flows through the U-shaped heat-exchanger tubes 17 toward the low-temperature chamber 20. More specifically, the steam flows through the holes **35*a* of the bellmouth plate 35, nozzle holes 31*a* of the nozzle members 31, and the heat-exchanger tubes 17 following the U-shaped paths so as to reheat the steam flowing outside of the heat exchanger tubes 17. In this case, since the diameter of the nozzle tip hole 33 is reduced from outside toward inside heat exchanger tube 17, the amount of the heating steam supplied into the inner tube such as tube 17*b* is reduced from that supplied into the outer tube such as tube 17*a*, and hence the difficulties such as the occurrence of hunting and damaging of the welded portions between the tubes 17 and the tube plate 26** can be substantially eliminated.

Furthermore, the corrosion of the internal surfaces of the heat-exchanger tubes 17 tending to be caused by the vortex created behind the nozzle hole 33 can be prevented effectively by the insert pipe 34.

Figure 6:
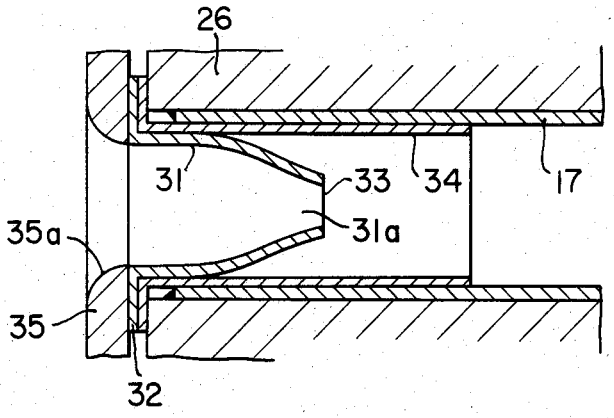
FIG. 6 is a longitudinal sectional view showing a nozzle constituting another embodiment of this invention.

FIG. 6 illustrates another embodiment of the present invention, wherein the nozzle member 31 is made by drawing a pipe having a constant thickness such that the inner diameter of the pipe is gradually reduced to form the nozzle tip hole 33. In this manner a material constructing the nozzle member 31 can be minimumly reduced in amount thereby to remarkably reduce the weight thereof.

Figure 7:
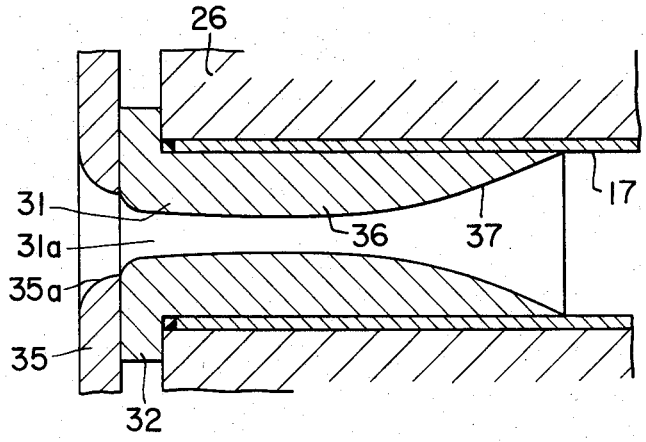
FIGS. 7 and 8 are longitudinal sectional views showing nozzles constituting further embodiments of this invention.

In still another embodiment shown in FIG. 7, the nozzle member 31 comprises a portion having an inner diameter gradually reduced into a throat 36, and another portion 37 wherein the diameter is gradually increased from the throat 36 to a value substantially equal to that of the heat exchanger tubes 17. In this embodiment also, the flange portion 32 of the nozzle member 31 is pressed by the bellmouth plate 35 toward the tube plate 26, and the diameter of the throat 36 is varied in accordance with the position of the tube 17. That is, the diameter of the throat 36 is reduced from the outermost tube 17*a* toward the innermost tube 17*b* within the heat-exchanger tubes 17. In this embodiment, since the steam passed through the throat 36 expands gradually along the portion 37 in which the hole diameter of the nozzle member 31 expands gradually, the aforementioned vortex causing corrosion of the inner surface of the heat exchanger tube 17 is not created, and hence the insert pipe 34 provided in the above described embodiments is not required in this embodiment.

Figure 8:
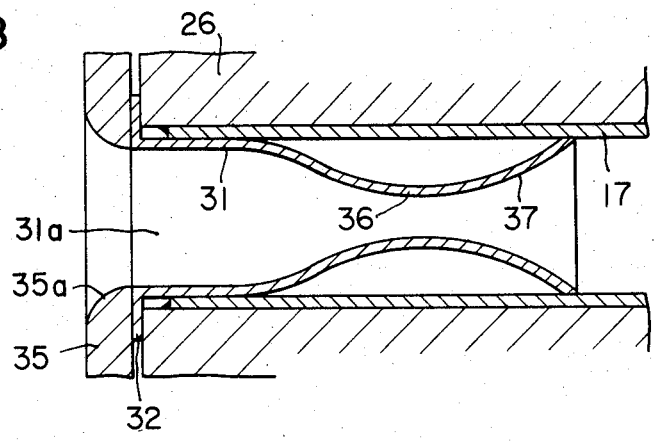

In still another embodiment shown in FIG. 8, the nozzle member 31 drawn out of a pipe having a constant thickness as shown in FIG. 6, is further provided with a throat 36 and a gradually expanding portion 37 following the throat, as in the embodiment shown in FIG. 7.

Figure 9:
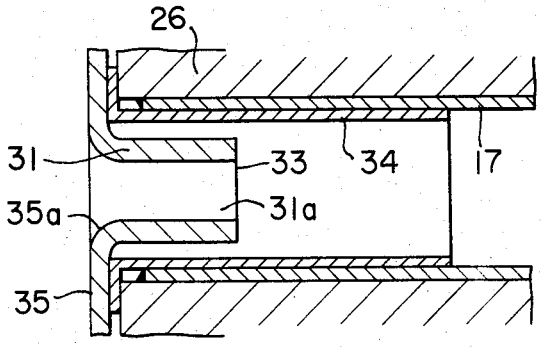
FIG. 9 is a longitudinal sectional view showing yet another embodiment of this invention.
Figure 10:
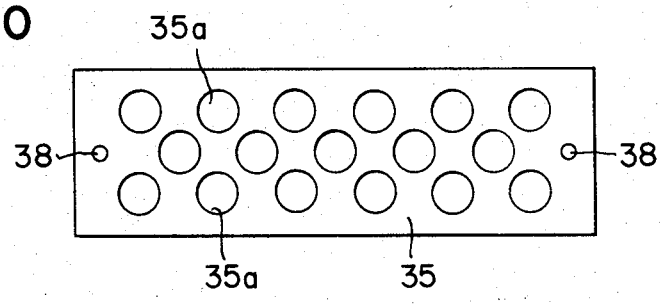
FIG. 10 is a plan view showing a bellmouth plate integrally provided with nozzles which is used in the embodiment shown in FIG. 9.

In still another embodiment shown in FIGS. 9 and 10, the nozzle members 31 and the bellmouth plate 35 are formed into an integral member. More specifically, a rectangular bellmouth plate 35 as described in the embodiment shown in FIG. 9 is further provided with nozzles 31 at positions aligning with the U-shaped heat-exchanger tubes 17, each of the nozzles 31 being provided with a nozzle hole 31*a* having a stream-lined inlet portion 35*a*. An insert pipe 34 is also provided as in the embodiments shown in FIGS. 5 and 6 for preventing corrosion of the inner surface of the heat exchanger tubes 17. Numeral 38 shown in FIG. 10 designates holes, through which bolts and the like are inserted to secure the bellmouth plate 35 to the tube plate 26.

Figure 11:
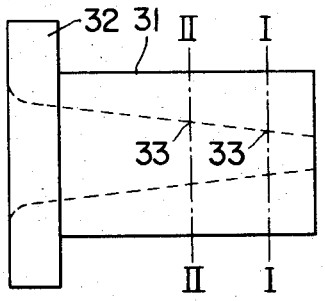
FIGS. 11 and 12 are diagrams for explaining an advantageous production method of the nozzles.
Figure 12:
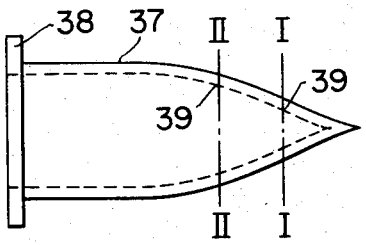

According to the present invention, a large number of nozzle members 31 having nozzle tip holes 33 of different diameters which are gradually reduced can be produced advantageously by firstly producing a number of nozzle members of the same construction having an internal hole reduced toward the downstream end as shown in FIG. 11 or 12 and then cutting off the end portions as shown by a cutting line I—I or II—II, for example.

According to the present invention, since nozzle members are inserted into the heat-exchanger tubes under pressure of the bellmouth plate and since the diameters of the nozzle holes are varied in accordance with the positions of the heat-exchanger tubes, heating steam flow rate through the heat-exchanger tubes can be varied in accordance with the heat duty carried out through the heat-exchanger tubes, and the hunting phenomenon and the possibility of damaging the welded portion between the heat-exchanger tube and the tube plate can be substantially eliminated. Furthermore, since the nozzle members are secured to the tube plate by means of the bellmouth plate, the inspection and replacement of the nozzle members are facilitated and leakage of steam tending to by-pass a certain portion of the heat-exchanger tubes can thereby be prevented.

What is claimed is:

1. In a steam reheating device for a steam power plant of the type comprising a number of heat-exchanger tubes bent into U shape through which heating steam is passed to reheat steam flowing outside of said heat-exchanger tubes, a tube plate having holes for tightly receiving upstream and downstream ends of the U-shaped heat-exchanger tubes, and a header portion separated into a high-temperature chamber and a low-temperature chamber connected to the upstream ends and the downsteam ends of the heat-exchanger tubes, respectively, the improvement comprising:

corrosion preventing insert pipes each having an integrally formed flange portion and inserted detachably into an upstream end portion of each of said heat-exchanger tubes so that said flange portion abuts against said tube plate;

nozzle members each having a length shorter than that of said insert pipe and also having a flange portion, said nozzle member being inserted into said insert pipe until said flange poriton of said nozzle member abuts against said flange portion of said insert pipe, the configuration of said nozzle member being differentiated depending on in which of said heat-exchanger tubes the nozzle member is received; and a bellmouth plate provided with a number of bellmouth-shaped holes and secured detachably to said tube plate such that said bellmouth-shaped holes are aligned with upstream end openings of said nozzle members in a streamlined manner and such that said flange portions of said insert pipes and said nozzle members are both firmly seized between said bellmouth plate and said tube plate.

* * * * *